United States Patent [19]

Strobl

[11] Patent Number: 4,790,338

[45] Date of Patent: Dec. 13, 1988

[54] COMBINED GOLFING UMBRELLA AND GOLF BALL RETRIEVER STRUCTURE

[76] Inventor: Thomas J. Strobl, 1011 Whittier Rd., Grosse Pointe Park, Mich. 48230

[21] Appl. No.: 717,143

[22] Filed: Mar. 28, 1985

[51] Int. Cl.[4] ..... A45B 3/00

[52] U.S. Cl. ..... 135/16; 135/19; 273/32 F; 294/19.2

[58] Field of Search ..... 135/16–19.5, 135/22, 22 M, 23, 69, 75, 24, 27, 28, 20, 38; 273/32 F; 294/19.2; 56/400.21; D21/234; D3/5, 6; 7/167, 170

[56] References Cited

U.S. PATENT DOCUMENTS

| | | | |
|---|---|---|---|
| 742,177 | 10/1903 | Flad | 135/28 |
| 1,182,617 | 5/1916 | Axberg | 135/26 |
| 1,532,802 | 4/1925 | Feistner | 135/16 |
| 1,659,482 | 2/1928 | Dennemark | 294/19.2 |
| 1,707,910 | 4/1929 | Haupt | 135/23 |
| 2,063,624 | 12/1936 | Raab et al. | 135/75 |
| 2,214,300 | 9/1940 | Henderson | 135/17 |
| 2,720,886 | 10/1955 | Byczek | 135/20 M |
| 3,239,264 | 3/1966 | Dupont | 294/19.2 |
| 3,922,026 | 11/1975 | Schweitzer | 294/19.2 |
| 3,982,781 | 9/1976 | Tucker et al. | 294/19.2 |
| 4,193,623 | 3/1980 | Forsythe | 135/16 |
| 4,310,189 | 1/1982 | Nihra | 273/32 F |
| 4,509,751 | 4/1985 | Tabet | 273/32 F |
| 4,522,300 | 6/1985 | Hamblet | 135/16 |
| 4,527,721 | 7/1985 | Goldstein | 135/16 |
| 4,659,125 | 4/1987 | Chuan | 403/104 X |
| 4,733,681 | 3/1988 | Lee | 403/104 X |

FOREIGN PATENT DOCUMENTS

| | | | |
|---|---|---|---|
| 2127572 | 12/1971 | Fed. Rep. of Germany | 135/75 |
| 433075 | 12/1911 | France | 135/16 |
| 1370800 | 7/1964 | France | 135/38 |

*Primary Examiner*—James R. Feyrer

*Attorney, Agent, or Firm*—Dale R. Small & Assoc.

[57] ABSTRACT

A combined golfing umbrella and golf ball retriever structure. In one embodiment golf ball retriever structure telescopes into and out of the handle end of a golfing umbrella. In another embodiment the golf ball retriever structure telescopes into and out of the umbrella screen end of a golfing umbrella.

18 Claims, 2 Drawing Sheets

FIG. 6
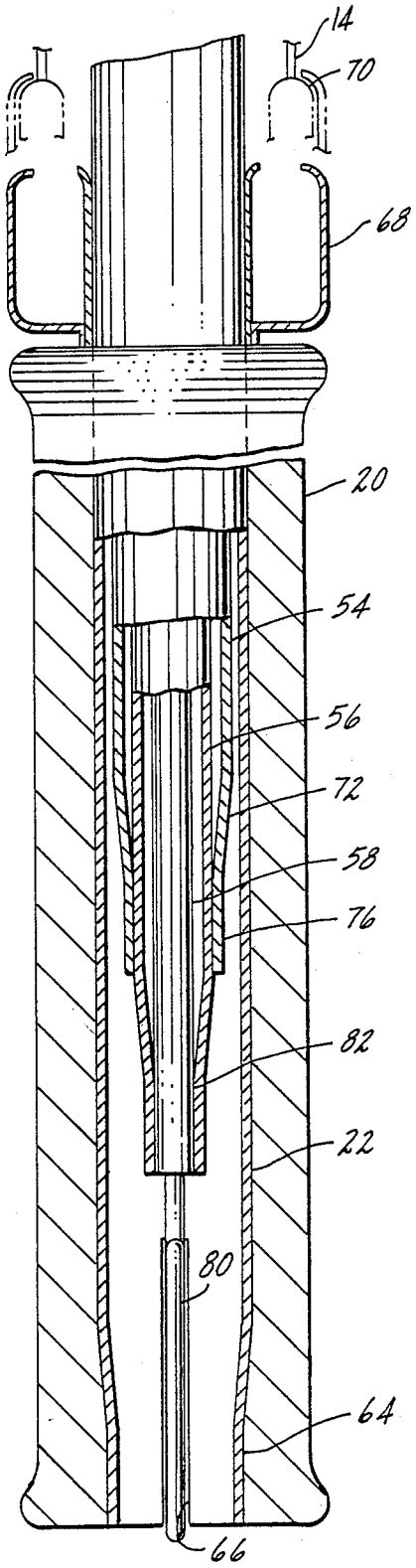
FIG. 7
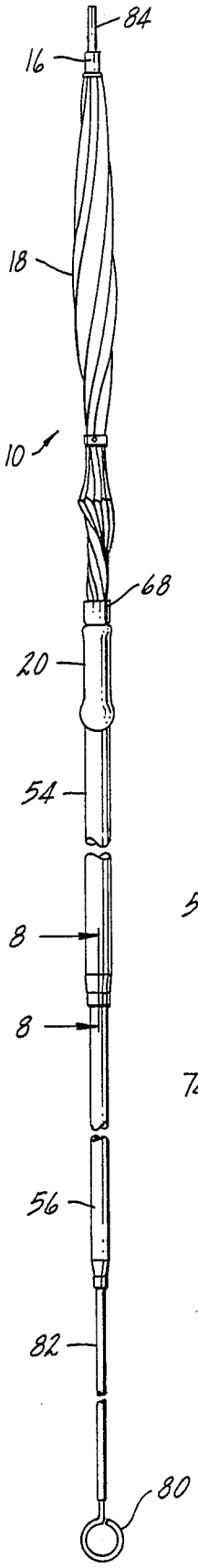
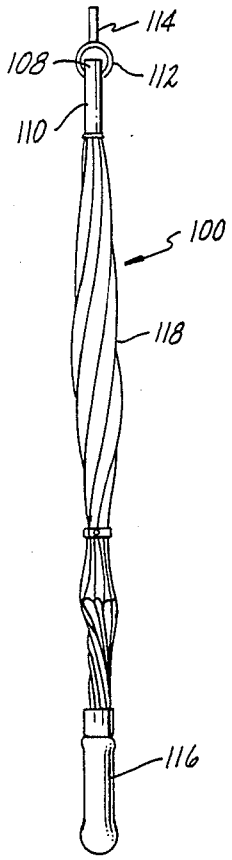
FIG. 9
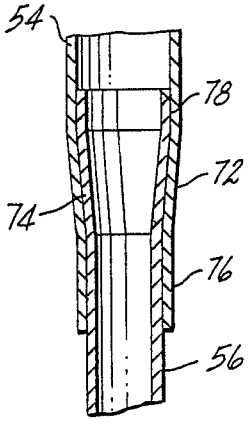
FIG. 8
FIG. 10
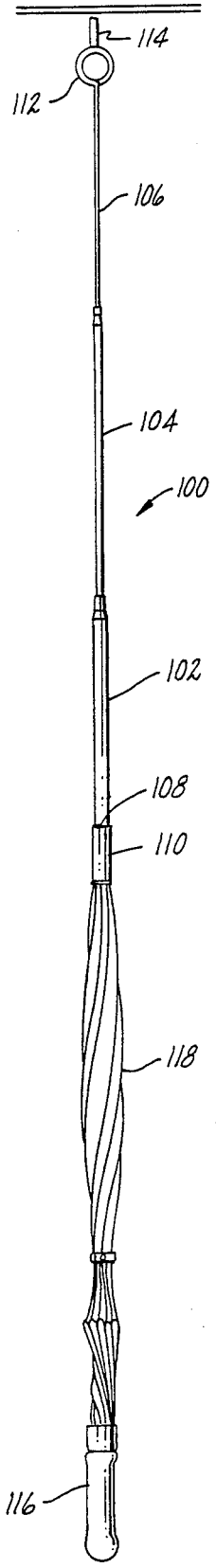

COMBINED GOLFING UMBRELLA AND GOLF BALL RETRIEVER STRUCTURE

BACKGROUND OF THE INVENTION

1. Field of the Invention

The invention relates to golfing accessory structures and refers more specifically to a combined golfing umbrella and golf ball retriever.

2. DESCRIPTION OF THE PRIOR ART

In the past, golfing accessory structures have included separate golfing umbrellas and separate golf ball retrievers. No prior combined golfing umbrella and golf ball retriever is known.

With separate golfing umbrellas and golf ball retrievers, it is necessary to carry two separate structures in or on an already crowded golf bag usually having a single location on the outside of the golf bag for securing either a golfing umbrella or gold ball retriever to the ball. With separate structures, if both golfing accessories are desired, one must be placed in the bag with the golf clubs which is inconvenient when selecting and removing and replacing clubs and may cause scratching of the golf clubs and/or damage to the golf ball retriever and golfing umbrella.

Further, separate golfing umbrellas and golf ball retrievers utilize many similar elements such as an outer shaft and handle which if separate golfing umbrellas and golf ball retrievers are carried, add to the weight of an already heavy golf bag without providing a comparable advantage over a combined golfing umbrella and golf ball retriever structure wherein such duplicate structure is utilized in use of both the umbrella and golf ball retriever functions of a combined device such as contemplated by the invention.

Also, prior golf ball retriever structure has not been provided with splash or spray protection useful for example, in retrieving golf balls in water side golf courses wherein water hazards are often large bodies of sometimes rough water and rocky coastlines producing splashing and spray. Similarly, prior golfing umbrellas have not been provided with long, telescoping shafts whereby a golfing umbrella may be rested with its shaft on the ground and the umbrella screen at a proper selected height to match the user's height, so that the tiresome holding of an umbrella may be eliminated by resting the umbrella shaft on the ground when the user is not moving.

SUMMARY OF THE INVENTION

The combined golfing umbrella and golf ball retriever structure of the invention includes a hollow elongated outer shaft section with an umbrella screen frame and umbrella screen at one end thereof and an umbrella handle at the other end. The outer shaft section surrounds a plurality of telescoping inner shaft sections which in telescope, relative relation are stored within the outer shaft section and which in extended, relative relation provide an elongated ball retriever shaft. Golf ball engaging structure is secured to the free or outer end of the smallest of the telescoping inner shaft sections.

In one modification of the invention, the telescoping inner shaft sections engaging are constructed and arranged to extend out of and telescope into the handle end of the outer shaft section. In another embodiment of the invention, the telescoping inner shaft sections are adapted to extend out of the umbrella screen end of the outer shaft section.

In the modification of the invention, wherein the telescoping inner shaft sections extend out of the handle end of the outer shaft section, in a collapsed position the umbrella screen end of the outer shaft section serves as a handle portion so that in use with one hand on the umbrella handle and the other hand on the collapsed umbrella wind screen, the ball engaging end member of the combined umbrella and golf ball retriever structure may be manipulated readily to retrieve a golf ball from a water hazard or the like. With the umbrella screen of such modification of the invention in the up position to protect the user from rain or the like, the telescoping inner sections of the shaft may be extended to provide an umbrella height desirable for the particular user with the golf ball engaging structure resting on the ground so that when the umbrella user is stationary it is not necessary for the user to support the full weight of the umbrella.

With the modification of the combined golfing umbrella and golf ball retrieving structure wherein the telescoping inner shafts section extend out of the umbrella screen end of the outer shaft section and with the combined golfing umbrella and golf ball retriever structure utilized as a golf ball retriever, the umbrella screen end of the outer shaft section may be utilized to provide a grip on the outer shaft section which in combination with a grip on the handle will again permit easy manipulation of the golf ball engaging structure on the end of the extended telescoping inner shaft sections. With the umbrella screen in an up or raised position, this modified combined golfing umbrella and golf ball retriever structure provides spray and splash protection while retrieving a gold ball from a water hazard or the like.

BRIEF DESCRIPTION OF THE DRAWINGS

FIG. 6 is an enlarged, broken, partial section view of the combined golfing umbrella and golf ball retriever illustrated in FIGS. 1 through 5 taken substantially on the line 6—6 in FIG. 2.

FIG. 7 is a broken side view of the combined golfing umbrella and golf ball retriever illustrated in FIGS. 1 through 6 showing the telescoping inner shaft sections extended from the handle end of the outer shaft section.

FIG. 8 is an enlarged partial section view of the structure shown in FIG. 7 taken substantially on the line 8—8 in FIG. 7.

FIG. 9 is a side view of a modified combined golfing umbrella and golf ball retriever similar to the side view of FIG. 1 wherein the telescoping inner shaft sections and golf ball engaging structure extend from the umbrella screen end of the outer shaft section.

FIG. 10 is a side view of the modified combined golfing umbrella and golf ball retriever illustrated in FIG. 9 showing the telescoping inner shaft sections extended.

DESCRIPTION OF THE PREFERRED EMBODIMENT

Figure 1:
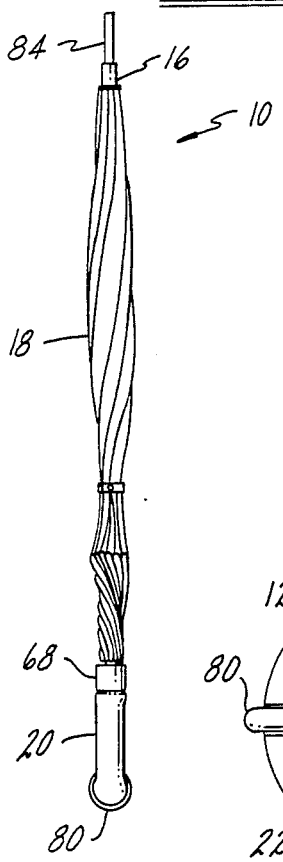
FIG. 1 is a side view of a combined golfing umbrella and golf ball retriever with the umbrella screen in a collapsed condition constructed in accordance with the invention wherein the golf ball retriever structure extends from the handle end of the combined golfing umbrella and golf ball retriever.

As shown in FIGS. 1 through 8, the combined golfing umbrella and golf ball retriever structure 10 includes an elongated hollow outer shaft section 12. An umbrella screen frame 14 is secured to the shaft 12 at one end 16 thereof and an umbrella screen 18 is positioned over and secured to the umbrella screen frame 14. A hollow cylindrical handle 20 is secured to the other end 22 of the outer shaft section 12. A plurality of telescoping, inner tube sections 54,56 and 58 having golf ball engaging structure on one end of the inner member thereof are supported by the outer tube section.

More specifically, the umbrella screen frame 14 includes a plurality of ribs 24 which are pivotally secured to the umbrella screen end 16 of the outer shaft section 12 at one end thereof and intermediate thereof to braces 26. Braces 26 are in turn pivotally secured at their inner ends to locking structure 28.

Figure 4:
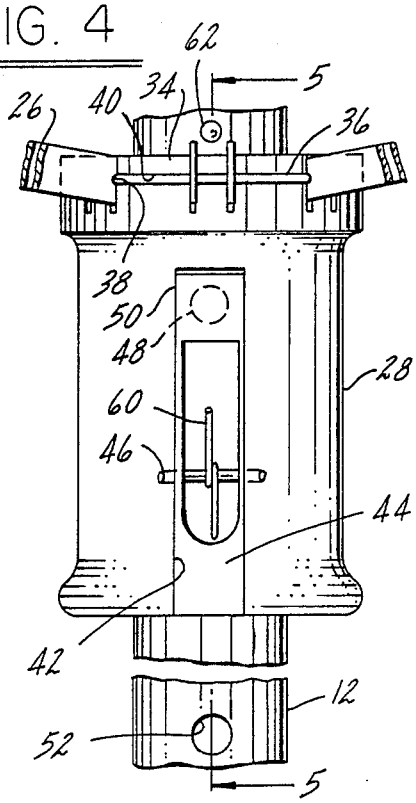
FIG. 4 is an enlarged, broken partial side view of the combined golfing umbrella and golf ball retriever structure illustrated in FIGS. 1 through 3 taken substantially on the line 4—4 in FIG. 2 and particularly showing the locking structure for the umbrella screen frame.
Figure 5:
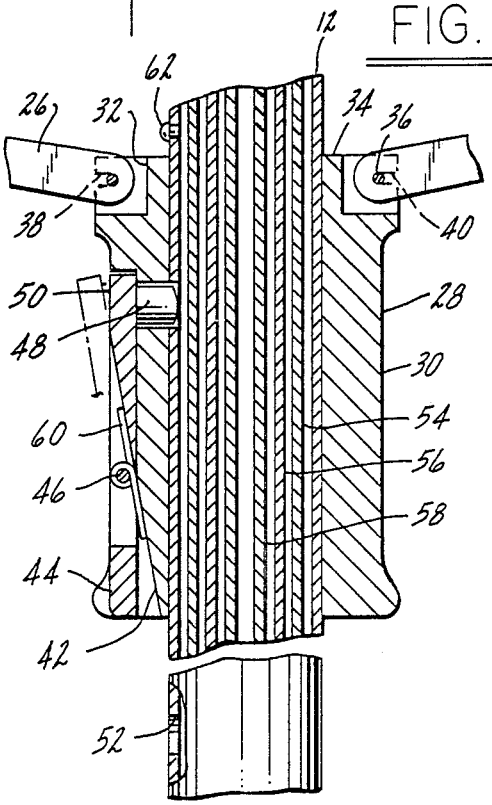
FIG. 5 is a partial section view of the structure shown in FIG. 4 taken substantially on the line 5—5 in FIG. 4.

As best shown in FIGS. 4 and 5, the locking structure 28 includes a hollow cylindrical member 30, sleeved over the outer shaft section 12. The inner ends of the braces 26 are secured to the cylindrical member 30 in slots 32 extending axially and radially of the member 30 in the end 34 thereof. The braces 26 are pivotally mounted on annular retaining ring 36 passed through openings 38 in the braces 26 and located within the annular groove 40 adjacent the end 34 of the cylindrical member 30. The braces 26 are thus pivotally mounted for movement through substantially 90° required to open and close the umbrella screen frame 14 as will be understood by those in the art.

Recess 42 extends axially of the cylindrical member 30 and as shown a lever 44 is pivotally mounted in the recess 42 by the pivot pin 46. Lever 44 has a locking pin 48 on end 50 thereof which in one pivotally limited position of the lever 44 extends into one of a plurality of axially spaced apart openings 52 in the outer shaft section 12. In this regard, it will be particularly noted that the locking pin 48 is of a length to extend just through the wall of the hollow shaft section 12 so that it does not interfere with the movement of the inner telescoping shaft sections 54, 56 and 58.

Lever 44 is urged into its locking pivotally limited position within the recess 42 by the spring 60.

In operation, when it is desired to raise or lower the umbrella frame 14 having the umbrella screen 18 attached thereto, the lever 44 as shown best in FIG. 5 is rotated in a counter clockwise direction to remove the pin 48 from engagement with an opening 52 in the outer shaft section 12. With the lever 44 so pivoted, the cylindrical member 30 may be moved axially of the outer shaft section 12 to any desired position to raise or lower the umbrella frame and screen. Subsequently, the lever 44 is released and on slight additional axial movement of the cylindrical member 30 the pin 48 under urging of spring 60 will seat in one of the openings 52 to lock the cylindrical member 30 in a desired position thereof.

A stop 62 is provided on the outer shaft section 12 to limit the movement of the cylindrical member 30 toward end 16 of the shaft section 12.

As shown best in FIG. 6, the handle 20 is hollow and is rigidly secured to the lower end 22 of the outer tubular shaft 12 which as shown has a reduced diameter terminal portion 64 as will be considered as subsequently in the discussion of the telescoping inner tubular shaft sections 54, 56 and 58. Handle 20 is provided with an axially extending transverse slot 66 for receiving the golf ball engaging structure 68 on retraction of the inner telescoping shafts 54, 56 and 58 shown in FIG. 6.

Annular retainer structure 68 is axially slideably mounted on the outer shaft section 12 as shown best in FIG. 6 immediately above the handle 20. In use the annular retainer structure 68 is slipped to the top of the handle 20 on the shaft section 12 when the umbrella frame 14 is closed. With the umbrella frame 14 closed, the annular retainer structure 68 is moved away from the handle 20 axially along the shaft section 12 to engage the free tips 70 of the ribs 24 of the umbrella frame structure 14 to retain them in a closed position.

The ends of the telescoping inner shaft sections 54, 56 and 58 are provided with mating conical portions 72 and 74 as shown in FIG. 8 on the outer end of shaft section 54 and inner end of shaft section 56 respectively in conjunction with a reduced diameter end portion 76 as shown on shaft section 54 and on enlarged diameter end portion 78 on shaft section 54, 56 whereby the inner shaft sections 54, 56 and 58 are guided in their telescoping movement into and out of the outer shaft section 12.

As shown best in FIGS. 6 and 7, a circular golf ball engaging ring 80 is secured to the outer or free end 82 of the inner tubular shaft section 58 by convenient means such as welding, soldering, pinning or the like. The ring 80 has a diameter slightly less than that of a gold ball.

Figure 2:
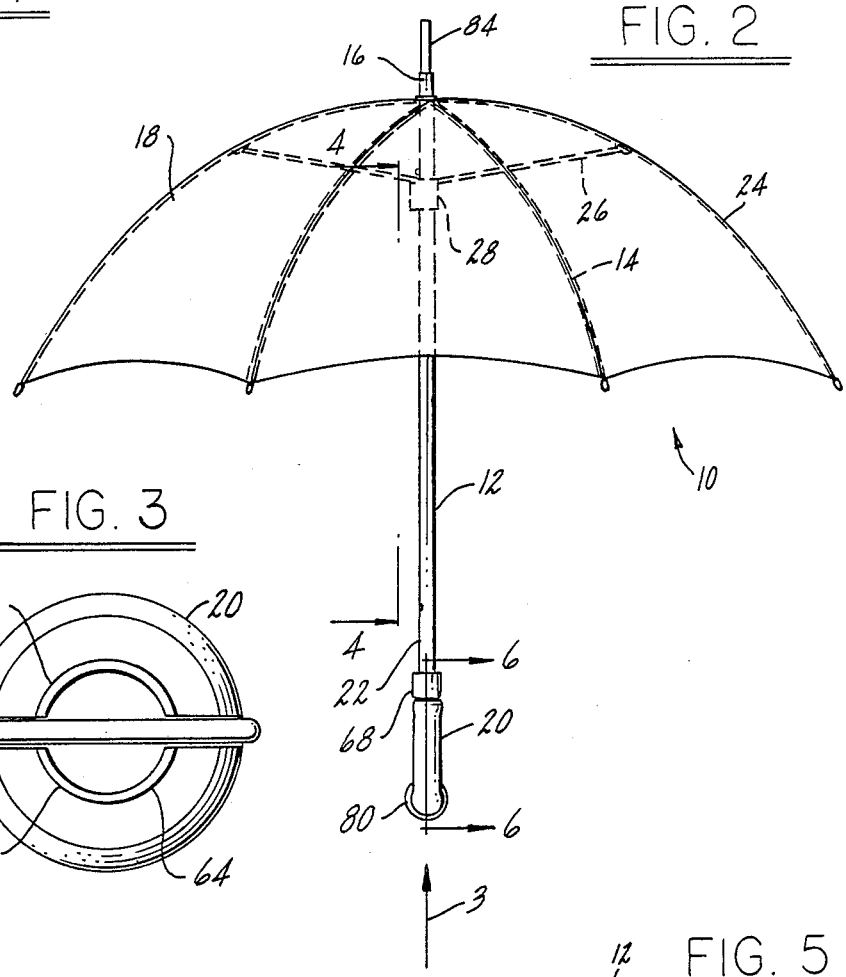
FIG. 2 is a side view of the combined golfing umbrella and golf ball retriever illustrated in FIG. 1 showing the umbrella screen in an open position.
Figure 3:
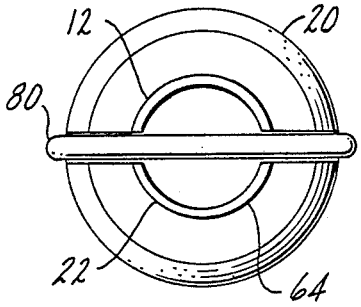
FIG. 3 is an enlarged bottom view of the handle portion of the combined golfing umbrella and golf ball retriever structure illustrated in FIGS. 1 and 2 taken substantially in the direction of arrow 3 in FIG. 2.

Thus, in overall use of the combined golfing umbrella and golf ball retriever 10, as shown in FIGS. 1 through 8, the structure 10 may be utilized as a normal umbrella when open in the configuration shown in FIG. 2. Should carrying the umbrella becomes tiresome, it may be rested on the extended golf ball engaging ring 80 with the telescoping inner shaft sections 54, 56 and 58 pulled out of the outer shaft section 12 a desired distance as for example, shown in FIG. 7 wherein the umbrella frame and screen is shown collapsed or closed. Thus the inner telescoping shafts 54, 56 and 58 provide a support on which the umbrella frame and umbrella screen may be rested in use due to frictional resistance to telescoping of the inner telescoping shaft sections 54, 56 and 58.

When it is desired to utilize the golfing accessory structure 10 as a golf ball retriever with the umbrella frame and umbrella screen in a collapsed or down position as shown in FIG. 7, the telescoping inner shaft sections 54, 56 and 58 are extended and with one hand on the handle 20 and the other hand on the umbrella screen adjacent the end 16 of the outer shaft section 12, the golf ball engaging ring 80 is passed under the golf ball to be retrieved from a water hazard or the like and the golf ball is raised and returned to the user of the structure 10. In such use of the structure 10, the end 16 of the outer shaft 12 and the umbrella frame and screen increase the length of the handle 20 to facilitate accurate control of the positioning of the golf ball engaging ring 82.

In the modified golf accessory structure 100 shown in FIGS. 9 and 10, the telescoping inner shaft sections 102, 104 and 106 extend into and out of the end 108 of the outer hollow cylindrical shaft 110. In the closed position, the golf ball engaging ring 112 is received in a slot extending radially and axially across the end 108 of the outer shaft section 110.

Further, in the modification of the golfing accessory structure 100 shown in FIGS. 9 and 10, a cylindrical locating member 114 is secured to the golf ball engaging ring 112 in alignment with the shaft supporting the ring 112. The locating member 114 is utilizing to position the golf accessory structure 100 on a golf bag having an opening for receiving the location member 114 adjacent the bottom of the bag and a strap or the like for securing the handle or adjacent structure to the top of the golf bag.

Further, in use of the golfing accessory structure 100 as shown in FIGS. 9 and 10 with the shaft sections 102, 104 and 106 extended as shown in FIG. 10, one hand may be positioned on the handle 116 and the other hand positioned to grip the outer shaft section 108 through the umbrella screen 118 and frame (not shown). The golf ball engaging structure 112 is thus easily maneuvered beneath a ball in a water hazard or the like as before. If the water hazard is of a type where waves cause splashing or spray, or if it is desired to retrieve a golf ball from a sprinkling area where sprinkling has been initiated and no turn off of the sprinkling is possible on the golf course by the individual golfer, the umbrella screen and frame may be opened to provide protection from the splashing or spray for a user attempting to retrieve a golf ball.

With the telescoping shaft sections in a retracted condition the golfing umbrella and golf ball retriever structure 100 may be used as a normal golfing umbrella. In such use of the structure 100 the telescoping inner shaft sections 102, 104 and 106 may be extended whereby the golf ball engaging member 112 will serve to provide a high marker of the whereabouts of the user of the structure 100.

While one embodiment of the present invention has been considered in detail along with a modification thereof, it will be understood that other embodiments and modifications of the invention are contemplated. It is the intention to include all embodiments and modifications of the invention as are defined by the appended claims within the scope of the invention.

I claim:

1. Golfing accessory structure comprising a combined golfing umbrella and golf ball retriever including an outer hollow shaft section, an umbrella screen frame secured to the outer shaft section at one end thereof, an umbrella screen secured to the umbrella screen frame for sheltering a golfer from rain, a handle at the other end of the outer shaft section, telescoping inner shaft sections including means constructed and arranged to telescope into and out of the outer shaft section from the one end thereof and golf ball engaging structure secured to one end of the smallest diameter telescoping inner shaft section specifically constructed and arranged to facilitate picking up golf balls from a distance outside the usual reach of a golfer by a golfer.

2. Structure as set forth in claim 1 wherein the golf ball engaging structure comprises an annular member secured to the free end of the smallest diameter telescoping inner shaft section having an inner diameter slightly less than the outer diameter of a golf ball.

3. Golfing accessory structure comprising an elongated cylindrical outer shaft section, an umbrella screen frame secured to the outer shaft section at one end thereof, an umbrella screen secured to the umbrella screen frame for sheltering a golfer from rain, a handle at the other end of the outer shaft section and golf ball retriever structure including a plurality of telescoping inner shaft sections received within the outer shaft section for telescoping into and out of the handle end of the outer shaft section carried by the hollow shaft section and having a free end extending out of the handle end thereof and means secured to the free end of the plurality of telescoping inner shaft sections specifically constructed and arranged to facilitate picking up golf balls from a distance outside the normal reach of a golfer by a golfer.

4. Structure as set forth in claim 3 wherein the means to facilitate picking up golf balls comprises an annular golf ball engaging member having an inner diameter slightly less than the outer diameter of a golf ball secured to the free end of the smallest diameter inner telescoping shaft section.

5. Golfing accessory structure comprising a combined golfing umbrella and golf ball retriever including an outer hollow shaft section, an umbrella screen secured to the outer shaft section at one end thereof, a handle at the other end of the outer shaft section, telescoping inner shaft sections constructed and arranged to telescope into and out of the outer shaft section, golf ball engaging structure secured to one end of the smallest diameter telescoping inner shaft section, including an annular member secured to the free end of the smallest diameter telescoping inner shaft section having an inner diameter slightly less than the outer diameter of a golf ball and a cylindrical extension on the annular member aligned with the shaft sections and on an opposite, exterior portion of the periphery of the annular member from the shaft sections for positioning the golfing accessory structure on a golf bag or the like.

6. Golfing accessory structure comprising an elongated cylindrical shaft section, an umbrella screen frame secured to the outer shaft section at one end thereof and a hollow cylindrical member sleeved over the outer shaft section and secured to the umbrella screen frame for opening and closing of the umbrella screen on sliding axial movement of the cylindrical member axially of the outer shaft section, a handle at the other end of the outer shaft section and golf ball retriever structure carried by the hollow shaft section and extending out of the handle end thereof which golf ball retriever structure includes a plurality of telescoping inner shaft sections received within the outer shaft section for telescoping into and out of the handle end of the outer shaft section and an annular golf ball engaging member having an inner diameter slightly less than the outer siameter of a golf ball secured to the free end of the smallest diameter inner telescoping shaft section and a radially and axially extending slot in the end of the handle for receiving the annular golf ball engaging member with the inner shaft sections telescoped within the outer shaft section.

7. Structure as set forth in claim 6 wherein the combined golfing umbrella and golf ball retriever includes means secured to the cylindrical member for locking the cylindrical member in axially adjusted position on the outer shaft section without interference with axial movement of the telescoping inner shaft sections into or out of the outer shaft section.

8. Structure as set forth in claim 7 wherein the locking means comprises a plurality of axially spaced apart openings aligned along the outer shaft section, a lever pivotally secured to the cylindrical member having a locking pin on one end thereof engageable with one of the openings in the outer shaft section, means urging the pin toward the outer shaft section and means integral with the cylindrical member for limiting pivotal movement of the lever to restrict movement of the locking pin into the outer shaft section to the depth of the thickness of a wall of the outer shaft section.

9. Structure as a set forth in claim 8 wherein the umbrella screen frame includes bracing members angularly spaced apart about one end of the cylindrical member and means for pivotally securing one end of the bracing members in angularly spaced apart relation to the one end of the cylindrical member comprising axially and radially extending slots in the one end of the cylindrical member receiving the one end of the bracing members and an annular groove around the one end of the cylindrical member and an annular member circular in cross section positioned within the annular groove and extending through the one end of the bracing members.

10. Golfing accessory structure comprising a combined golfing umbrella and golf ball retriever including an outer hollow shaft section, an umbrella screen frame secured to the outer shaft section at one end thereof, a hollow cylindrical member sleeved over the outer shaft section and secured to the umbrella screen frame for raising and lowering the umbrella screen frame on axial movement of the cylindrical member along the outer shaft section, an umbrella screen secured to the umbrella screen frame, a handle at the other end of the outer shaft section, telescoping inner shaft sections constructed and arranged to telescope into and out of the outer shaft section from the one end thereof and golf ball engaging structure secured to one end of the smallest diameter telescoping inner shaft section including an annular member secured to the free end of the smallest diameter telescoping inner shaft section having an inner diameter slightly less than the outer diameter of a golf ball and further including a cylindrical extension on the annular member aligned with the shaft sections and on an opposite, exterior portion of the periphery of the annular member from the hollow shaft section, for positioning the golfing accessory on a golf bag or the like.

11. Structure as set forth in claim 10 wherein the combined golfing umbrella and golf ball retriever includes means secured to the cylindrical member for locking the cylindrical member in axially adjusted positions on the outer shaft section without interference with axial movement of the telescoping inner shaft sections into or out of the outer shaft section.

12. Structure as set forth in claim 11 wherein the locking means comprises a plurality of axially spaced apart openings aligned along the outer shaft section, a lever pivotally secured to the cylindrical member having a locking pin on one end thereof engageable with one of the openings in the outer shaft section, means urging the pin toward the outer shaft section and means integral with the cylindrical member for limiting pivotal movement of the lever to restrict movement of the locking pin into the outer shaft section to the depth of the thickness of a wall of the outer shaft section.

13. Structure as set forth in claim 12 wherein the umbrella screen frame includes bracing members angularly spaced apart about one end of the cylindrical member and means for pivotally securing one end of the bracing members in angularly spaced apart relation to the one end of the cylindrical member comprising axially and radially extending slots in the one end of the cylindrical member receiving the one end of the bracing members and an annular groove around the one end of the cylindrical member and an annular member circular in cross section positioned within the annular groove and extending through the one end of the bracing members.

14. Golfing accessory structure comprising a combined golfing umbrella and golf ball retriever including an outer hollow shaft section, an umbrella screen secured to the outer shaft section at one end thereof, a handle at the other end of the outer shaft section, telescoping inner shaft sections constructed and arranged to telescope into and out of the outer shaft section, golf ball engaging structure secured to one end of the smallest diameter telescoping inner shaft section including an annular member secured to the free end of the smallest diameter telescoping inner shaft section having an inner diameter slightly less than the outer diameter of a golf ball and a radially and axially extending slot in an end of the outer shaft section for receiving the annular golf ball engaging member with the inner shaft sections telescoped within the outer shaft section.

15. Structure as set forth in claim 14 wherein the golf ball retriever structure is at the one end of the outer shaft section.

16. Structure as set forth in claim 14 wherein the golf ball retriever structure is at the other end of the outer shaft section.

17. Golfing accessory structure comprising an elongated cylindrical outer shaft section, an umbrella screen frame secured to the outer shaft section at one end thereof and a hollow cylindrical member sleeved over the outer shaft section and secured to the umbrella screen frame for opening and closing of the umbrella screen frame on sliding movement of the cylindrical member axially of the outer shaft section, a handle at the other end of the outer shaft section and golf ball retriever structure carried by the hollow shaft section and extending out of the handle end thereof including a plurality of telescoping inner shaft sections received within the outer shaft section for telescoping into and out of the handle end of the outer shaft section and an annular golf ball engaging member having an inner diameter slightly less than the outer diameter of the golf ball secured to the free end of the smallest diameter inner telescoping shaft section, a radially and axially extending slot in the end of the handle for receiving the annular golf ball engaging member with the inner shaft section telescoped within the outer shaft section, means secured to the cylindrical member for locking the cylindrical member in axially adjusted position on the outer shaft section without interference with axial movement of the telescoping inner shaft sections into or out of the outer shaft section comprising a plurality of axially spaced apart openings aligned along the outer shaft section, a lever pivotally secured to the cylindrical member having a locking pin on one end thereof engageable with one of the openings in the outer shaft section, means urging the pin toward the outer shaft section and means integral with the cylindrical member for limiting pivotal movement of the lever to restrict movement of the locking pin into the outer shaft section to the depth of the thickness of a wall of the outer shaft section, said umbrella screen frame further including bracing members angularly spaced apart about one end of the cylindrical member and means for pivotally securing one end of the bracing members in angularly spaced apart relation to the one end of the cylindrical member comprising axially and radially extending slots in the one end of the cylindrical member receiving the one end of the bracing members and an annular groove around the one end of the cylindrical member and an annular member, circular in cross section, positioned within the annular groove and extending through the one end of the bracing members.

18. Golfing accessory structure comprising a combined golfing umbrella and golf ball retriever including an outer hollow shaft, an umbrella screen frame secured to the outer shaft section at one end thereof, a hollow cylindrical member sleeved over the outer shaft section and secured to the umbrella screen frame for raising and lowering the umbrella screen frame on axial movement of the cylindrical member along the outer shaft section, an umbrella screen secured to the umbrella screen frame, a handle at the other end of the outer shaft section, telescoping inner shaft sections constructed and arranged to telescope into and out of the outer shaft section from the one end thereof and golf ball engaging structure secured to one end of the smallest diameter telescoping inner shaft section which golf ball engaging structure comprises an annular member secured to the free end of the smallest diameter telescoping inner shaft section having an inner diameter slightly less than the outer diameter of a golf ball and further includes a cylindrical extension on the annular member aligned with the shaft sections and on an opposite exterior portion of the periphery of the annular member from the shaft sections for positioning the golf accessory structure on a golf bag or the like, means secured to the cylindrical member for locking the cylindrical member in axially adjusted positions on the outer shaft section without interference with axial movement of the telescoping inner shaft sections into or out of the outer shaft section comprising a plurality of axially spaced apart openings aligned along the outer shaft section, a lever pivotally secured to the cylindrical member having a locking pin on one end thereof engageable with one of the openings in the outer shaft section, means urging the pin towards the outer shaft section and means integral with the cylindrical member for limiting pivotal movement of the lever to restrict movement of the locking pin into the outer shaft section to the depth of the thickness of a wall of the outer shaft section, said umbrella screen frame including bracing members angularly spaced apart about one end of the cylindrical member and means for pivotally securing one end of the bracing members in angularly spaced apart relation to the one end of the cylindrical member comprising axially and radially extending slots in the one end of the cylindrical member receiving the one end of the bracing members and an annular groove around the one end of the cylindrical member and an annular member, circular in cross section, positioned within the annular groove and extending through the one end of the bracing members.

* * * * *